United States Patent [19]

Stern et al.

[11] Patent Number: 4,490,700

[45] Date of Patent: Dec. 25, 1984

[54] DIELECTRIC WAVEGUIDE FERRITE MODULATOR/SWITCH

[75] Inventors: Richard A. Stern, Allenwood; Richard W. Babbitt, Fairhaven, both of N.J.

[73] Assignee: The United States of America as represented by the Secretary of the Army, Washington, D.C.

[21] Appl. No.: 445,799

[22] Filed: Dec. 1, 1982

[51] Int. Cl.[3] ..... H01P 1/11

[52] U.S. Cl. ..... 333/258; 333/102; 333/24.3; 333/239

[58] Field of Search ..... 333/102, 24.3, 21 A, 333/239, 258, 248; 332/51 W

[56] References Cited

U.S. PATENT DOCUMENTS

| | | | |
|---|---|---|---|
| 2,719,274 | 9/1955 | Luhrs | 333/24.3 |
| 3,018,454 | 1/1962 | Sferrezza | 333/24.3 X |
| 3,064,214 | 11/1962 | Miller | 333/24.3 X |
| 3,982,213 | 9/1976 | Smith et al. | 333/21 A X |
| 4,415,871 | 11/1983 | Stern et al. | 333/248 X |

*Primary Examiner*—Paul Gensler

*Attorney, Agent, or Firm*—Anthony T. Lane; Jeremiah G. Murray; Edward Goldberg

[57] ABSTRACT

A ferrite modulator/switch is disclosed for use in a dielectric waveguide transmission line. A ferrite guide section inserted in a dielectric transmission line is longitudinally magnetized to cause a 90° rotation of a wave traveling through the guide thereby inhibiting further propagation and resulting in the scattering out of wave energy away from the dielectric line.

5 Claims, 2 Drawing Figures

DIELECTRIC WAVEGUIDE FERRITE MODULATOR/SWITCH

STATEMENT OF GOVERNMENT INTEREST

The invention described herein may be manufactured, used and licensed by or for the Government for Governmental purposes without the payment to me of any royalties thereon.

BACKGROUND OF THE INVENTION

This invention relates generally to the field of dielectric waveguide transmission line components operating in the millimeter wave frequency region, and more particularly, to a modulator or switch for controlling electromagnetic wave propagation in a dielectric waveguide circuit.

In millimeter-wave radar and communications systems where size, weight, efficiency and cost often dictate the use of the dielectric waveguide as the low-loss millimeter wave transmission line medium, switches are often required in order to modulate millimeter wave energy for systems applications or to isolate sensitive receiver components from damaging transmitter energy.

While the previous art in millimeter-wave switches is rather limited, earlier switch designs for use in metal waveguides operating in the millimeter wave region have centered around the use of a metal waveguide junction having a ferrite element to which an axial magnetic biasing field is applied to alter the effective permeability of the ferrite such that energy propagation in the guide is controlled. A device of this type is described by R. A. Stern in an article entitled "A Fast 3-mm Ferrite Switch," IEEE Transactions on Microwave Theory and Techniques, September, 1971.

In dielectric as opposed to metal waveguide structures, another type of switch is known. This configuration uses a dielectric transmission line having a semiconducting epitaxial layer to which a bias voltage is applied. The change in the effective depletion depth of the epitaxial layer brought about by the bias voltage results in change boundary conditions along the waveguide wall thereby controlling wave propagation in the guide. This particular design requires that the operating frequency of the guide be located near the cut-off frequency which results in a device having a rather narrow frequency band of operation.

None of these earlier devices has been successful in providing a broadband ferrite waveguide switch having t' capability of operating in the millimeter wave frequency region in a dielectric transmission line.

SUMMARY OF THE INVENTION

The object of this invention is to provide a ferrite modulator/switch for operation in the millimeter wave frequency region in a dielectric transmission line.

A further object of this invention is to provide a ferrite modulator/switch having a low insertion loss ($\sim 1$ dB) in the "on" state and a high attenuation ($>15$ dB) in the "off" state.

Another object of the invention is to provide a ferrite modulator/switch based on a simple, low cost design structure which is capable of operating in the 35 GHz frequency region.

The dielectric waveguide ferrite modulator/switch according to the invention employs a length of ferrite inserted in a dielectric transmission line circuit wherein the height and width dimensions of the ferrite are sufficient to permit the 90° rotation of a wave traveling through the ferrite. When the ferrite is magnetized longitudinally, millimeter wave energy passing through the length of ferrite is rotated out of alignment with the output dielectric by 90° so that the wave propagation cannot be sustained.

BRIEF DESCRIPTION OF THE DRAWINGS

These and other features of the present invention will be more readily understood from a consideration of the following description taken in connection with the accompanying drawings in which.

DESCRIPTION OF AN EMBODIMENT OF THE INVENTION

The dielectric waveguide ferrite modulator/switch according to the present invention utilizes the phenomena commonly known as Faraday rotation to induce rotation in a wave traveling through a ferrite section thereby inhibiting further propagation of the wave in the output dielectric waveguide. In this type of configuration, the switch design is based on propagation of the dominant $TE_{10}$ mode of propagation for the waveguide.

Figure 1:
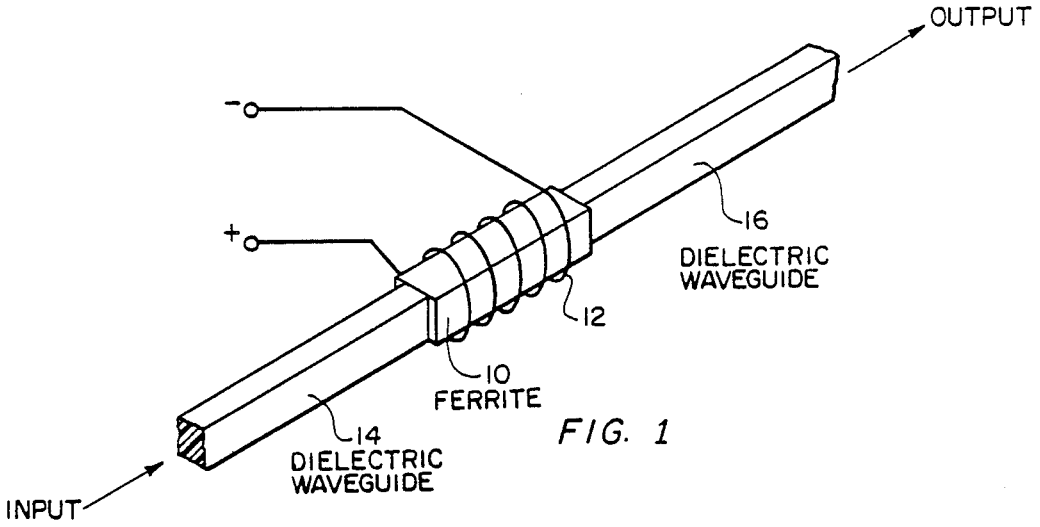
FIG. 1 shows an isometric view of a preferred embodiment of the invention.

Referring to FIG. 1, there is shown a millimeter-wave ferrite modulator/switch for operation in the 35 GHz frequency region consisting of a ferrite guide 10 and a switching coil 12, both of which are inserted between an input dielectric waveguide 14 and output dielectric waveguide 16. The precise dimensions of the ferrite guide 10 are controlled by the fact that the length, height and width must be sufficient to permit a 90° rotation of a wave traveling through the guide 10. In a preferred embodiment the dielectric waveguide input 14 and output 16 sections are of magnesium titanate having a relative dielectric constant $\epsilon=16$ and being 0.070" high and 0.050" wide and the ferrite guide 10 is 0.4" long, 0.070" high and 0.070" wide. The ferrite material utilized in this structure can be high $4\pi M_s$ NiZn or LiZn spinel type ferrite which are typical low-loss ferrites commonly used at millimeter frequencies.

One advantage of the design structure of the preferred embodiment lies in the fact that no complicated and costly impedance matching structure is required at the interfaces into and out of the ferrite guide 10 since the dielectric constant of the ferrite is similar to that of the dielectric waveguide input 14 and output 16. In the case where the dielectric and ferrite have substantially different dielectric constants, transformers may be used at the dielectric/ferrite junctions for impedance matching.

Referring again to FIG. 1 energy traveling down the input dielectric waveguide 14 enters the ferrite transmission line section 10. With zero voltage across switching wire coil 12, the millimeter wave energy travels through the ferrite guide 10 and into the output dielectric waveguide 16 with a low loss, typically on the order of 1 dB. When the ferrite guide 10 is magnetized longitudinally by means of the switching coil 12 which is energized to provide d.c. magnetic biasing, the polarization of the millimeter wave energy, upon entering the ferrite guide 10 from the input dielectric waveguide 14, is rotated 90° due to a change in the permeability of the ferrite material. Upon exiting from the ferrite guide 10, the polarization of the millimeter wave energy will be 90° out of proper alignment with respect to output dielectic waveguide 16. Due to the fact that the output dielectric waveguide 16 cannot sustain propagation of the wave in this orientation, the result is that the millimeter wave energy is radiated and scattered out and away from the dielectric guide yielding high signal attenuation (>15 dB). This off-on switching capability can be further employed as a modulator by continuously switching the unit off and on.

Figure 2:
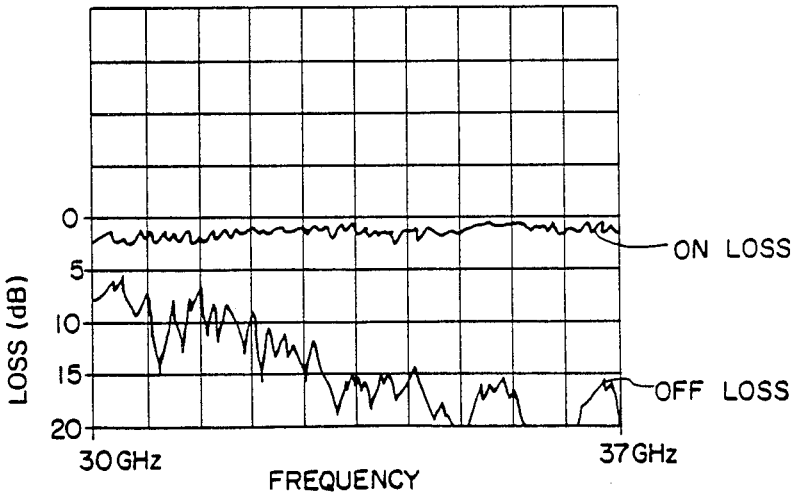
FIG. 2 shows a curve relating the insertion loss vs. frequency for the device shown in FIG. 1.

FIG. 2 shows the experimental results of the "off" and "on" states of a switch constructed in accordance with this invention. With the magnetic biasing field required for the "off" state being on the order of a few hundred oersteds, the "on" state loss is approximately 1 dB and the "off" state loss is greater than 15 dB over a greater than 10% bandwidth.

It should be understood that the foregoing disclosure relates to only a preferred embodiment of the invention and that numerous modifications or alterations may be made therein without departing from the spirit and scope of the invention as set forth in the appended claims.

What is claimed is:

1. A dielectric waveguide switch comprising:

a ferrite waveguide section having an input end and an output end, a first dielectric waveguide means connected to said input end of said ferrite section for providing an input signal and a second dielectric waveguide means connected to said output end for receiving an output signal from said ferrite section, and means for selectively rotating the polarization of signals propagating through said ferrite waveguide section.

2. A dielectric waveguide switch as set forth in claim 1 wherein said ferrite waveguide section and said first and second waveguide means have substantial equal dielectric constants.

3. A dielectric waveguide switch as set forth in claim 1 wherein said ferrite waveguide section has a square cross-section.

4. A dielectric waveguide switch as set forth in claim 1 wherein said means for including a magnetic field is a coil wrapped about said ferrite waveguide section and connected to a voltage source.

5. A dielectric waveguide switch as set forth in claim 1 wherein said ferrite waveguide section has a rectangular cross-section having height, width and length dimensions sufficient to permit a 90° rotation of a wave traveling therethrough.

* * * * *